United States Patent [19]

Krishan et al.

[11] Patent Number: 4,981,453

[45] Date of Patent: Jan. 1, 1991

[54] EMERGENCY TRANSMITTER BUOY AND BRACKET ASSEMBLY

[75] Inventors: Thomas R. Krishan, Newtown Square; Peter W. Bressler, Philadelphia; Harry F. Buschmeier, III, Lester; Fernando M. Guidone, Exton; Eugene F. Keohane, Philadelphia; Robert J. Malloy, Drexel Hill; Albert C. Paulovitz, Kennett Square; David R. Schiff, Philadelphia; Nicholas M. Tinari, Jr., Havertown; John G. Vattima, Prospect Park, all of Pa.

[73] Assignee: Litton Systems, Inc., Springfield, Pa.

[21] Appl. No.: 332,322

[22] Filed: Mar. 31, 1989

[51] Int. Cl.[5] ..... B63B 22/14

[52] U.S. Cl. ..... 441/6; 248/309.1; 441/10; 441/11; 441/16; 441/28

[58] Field of Search ..... 114/326, 328; 441/6, 441/7, 9, 10, 11, 12, 13, 16, 28, 27, 32; 248/316.1, 313, 309.1; 200/84 C; 335/207, 206, 205

[56] References Cited

U.S. PATENT DOCUMENTS

| | | | |
|---|---|---|---|
| 401,422 | 4/1889 | Ellicott | 248/316.1 |
| 2,369,971 | 2/1945 | Marr | 441/16 |
| 2,499,672 | 3/1950 | Nurkiewicz | 248/313 |
| 3,581,693 | 6/1971 | Basset | 441/16 |
| 3,594,669 | 7/1971 | Yamane et al. | 335/207 |
| 4,668,200 | 5/1987 | Kotoh et al. | 441/6 X |
| 4,784,360 | 11/1988 | Mok | 248/313 |

*Primary Examiner*—Sherman Basinger
*Attorney, Agent, or Firm*—Brian L. Ribando

[57] ABSTRACT

An emergency position indicating radio beacon is controlled by an annular switch ring which rotates to ON, OFF, SET, and TEST positions. In the SET position, the buoy transmitter automatically turns on in response to removal of the buoy from a mounting bracket. A light and an audible alarm on the buoy are activated during buoy transmission to alert an operator to the transmission in order to avoid false alarms. The mounting bracket automatically releases and ejects the buoy in an emergency situation in response to ambient water pressure, or the buoy may be manually removed from the bracket for deployment.

23 Claims, 5 Drawing Sheets

EMERGENCY TRANSMITTER BUOY AND BRACKET ASSEMBLY

BACKGROUND OF THE INVENTION

This invention relates to an emergency transmitter buoy and a mounting bracket therefor for use on marine vessels Emergency position indicating radio beacons (EPIRBs) are intended for use by mariners in an emergency situation. According to international agreements, the EPIRB transmits a homing signal on 121.5 mhz only or on both 121.5 and 243 mhz, as well as a satellite beacon signal on 406 mhz. In the event of an accident at sea or other distress situation, the EPIRB is manually deployed or, in the event there is no opportunity for manual deployment, automatically deployed in order to transmit the homing and satellite signals.

The EPIRB transmits a 406.25 mhz identification signal which is received by search and rescue satellite-aided tracking (SARSAT) satellites in orbit around the earth. The SARSAT is able to determine the position coordinates of the EPIRB by doppler shift techniques and to transmit the position of the EPIRB to one of several international ground receiving stations. The ground receiving station relays the position coordinates of the EPIRB as well as identification information relating to the vessel to which the EPIRB is assigned to a Mission Control Center (MCC). The MCC sends the location of the EPIRB to a rescue coordination center which deploys ships, planes, or helicopters as appropriate to the EPIRB site in order to provide rescue operations.

The 121.5 and 243 mhz signals are transmitted to ground based and other rescue facilities. Air and sea search and rescue (SAR) vehicles are able to home-in on the signals and thus locate the EPIRB and those in distress. As the SAR vehicles near the EPIRB, flashing lamp will become visible for final approach.

The EPIRB itself is housed in a buoy which is designed to float on the surface of the water. The upper portion of the buoy includes an antenna cone which contains the transmitting antenna for the buoy; and in order to aid in visual location of the EPIRB buoy in the water, the tip of the antenna cone is provided with a light. The housing of the EPIRB contains a battery pack and transmitter circuitry, and external switching means are provided to manually turn the EPIRB ON or OFF as required. Since the transmission of a signal by the EPIRB immediately sets into motion a full rescue operation, the EPIRB transmitter is never ON unless rescue assistance is required. The EPIRB is also designed to automatically turn ON in an emergency situation when manual activation of the transmitter is not possible.

Because of the high level of effort and cost attendant a rescue operation, especially at sea, the EPIRB transmitter manual and automatic turn-on mechanism must be designed to eliminate as much as possible transmitter false alarms. To this end, various switching schemes for transmitter turn-on have been attempted in the past. For example, since the EPIRB is normally mounted on an outside support surface of the vessel, position sensitive switches have been used which turn the transmitter ON if the orientation of the EPIRB changes drastically. This arrangement can result in false alarms, however, when the EPIRB unit is removed from its mount for inspection or maintenance without first turning the unit fully OFF. The capsizing of a vessel immerses the EPIRB in sea water; and for this reason, switch contacts which close to turn the unit ON when immersed conductive sea water have also been used. However, sea water switches are subject to false alarms caused by the accumulation of salt spray or corrosion which prematurely close the normally open switch contacts and turn the EPIRB transmitter ON.

With regard to the ergonomic design of the EPIRB controls, the transmitter switches must be clearly marked and simple to actuate and should provide visual assurance to an operator or observer that the EPIRB transmitter is in the operating mode which is intended.

The design of the EPIRB buoy mounting bracket is also critical since the bracket must hold and protect the buoy during normal shipboard activities and rough weather but must automatically deploy the buoy in the event of a sudden capsizing. The buoy must be released from the mounting bracket in the event of a capsized or partially submerged vessel; and since the buoy carries a lamp in order to aid in visual location, release from the mounting bracket and proper orientation of the lamp above the surface of the sea is essential. The design of the bracket should also protect the buoy as much as possible from falling objects or from lines or poles which may fall onto and become entangled with the buoy and its support.

SUMMARY OF THE INVENTION

An EPIRB transmitter buoy is intended for automatic deployment and turn-on in the event of an unexpected sinking or capsizing but may also be manually deployed and turned ON to initiate a search and rescue operation by activating the transmitter while the unit is still in the mount. The EPIRB buoy includes a series of magnetic switches for placing the unit in ON, OFF, SET, or TEST modes and for sensing whether the unit is in the mounting bracket or not. Some of the magnetic switches are actuated by a rotating switch ring which visually indicates the selected operating mode, and one of the switches is sensitive to the placement of the buoy in the mounting bracket. The buoy may be manually removed from the bracket by releasing a latch or may be automatically ejected from the bracket by means of a pressure sensitive module which releases the retaining strap and activates an ejection arm in the event of submersion of the bracket in water. The bracket supports the buoy and deflects away falling objects which would otherwise become wedged between the buoy and the bracket.

It is accordingly an object of the invention to provide a buoy and bracket assembly for use in transmitting a distress signal in the event of an emergency situation.

It is another object of the invention to provide an emergency transmitter buoy which automatically transmits a distress signal upon the occurrence of certain events but is designed to eliminate false alarms.

It is a further object of the invention to provide an emergency transmitter buoy having a plurality of magnetic switches and a manual switch for placing the transmitter in an intended mode of operation.

It is a further object of the invention to provide an automatic release and ejection mechanism for an emergency transmitter buoy which is normally securely strapped into a mounting bracket.

These and other objects of the invention will become apparent from the following detailed description of the invention in which reference numerals used throughout the description correspond to reference numerals shown on the accompanying drawing figures.

DESCRIPTION OF THE PREFERRED EMBODIMENT

Figure 1:
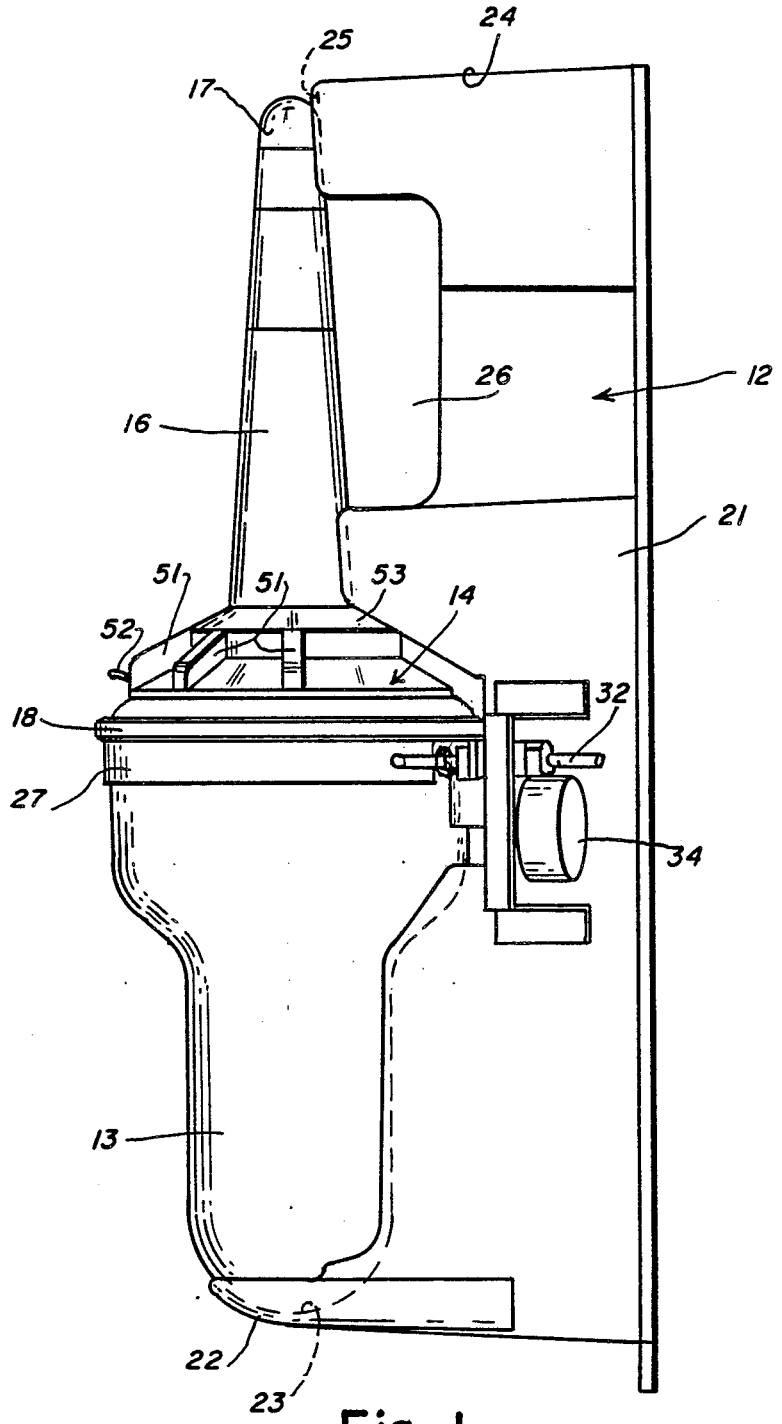
FIG. 1 is a side view of an emergency transmitter buoy in a mounting bracket.

Turning now to FIG. 1, there is shown an emergency position indicating rescue beacon (EPIRB) generally designated by the reference numeral 10. The EPIRB is mounted in a bracket 12 and comprises a lower cylindrical base 13, a middle deck portion 14, and a slender upper antenna cone 16. The antenna cone 16 is topped by a lamp 17 which may be either incandescent, gas, or of the Xenon strobe type. A clamping ring 18 secures the middle deck portion 14 to the lower cylindrical base portion 13 and an O-ring seal 11 best seen in FIG. 8 prevents the ingress of water through the seam between the two sections. The clamping ring 18 is removable to allow access to the interior of the buoy for routine maintenance and service work. The lower cylindrical base portion 13 has a rounded bottom 23 and includes a battery pack 19 in a waterproof enclosure 30 (also seen in FIG. 8) and one or more circuit cards 20 containing the circuitry for the buoy transmitter.

The bracket 12 may be mounted on a support surface 30 of a marine vessel and comprises an elongated bracket body 21 having a cup-shaped lower shelf 22 which receives the rounded bottom 23 of the buoy. The cup-shaped lower shelf 22 includes a drain slot 46, best seen in FIG. 2, in order to prevent water, which can freeze and inhibit separation of the buoy from the bracket, and other debris from collecting in the lower shelf 22. The upper portion of bracket body 12 includes a sloped top 24, the front portion of which is formed into a concave top rest 25. The concave top rest 25 is closely adjacent to and slightly above the tip of the buoy lamp 17. The combination of the sloped top 24 and the top rest 25 will naturally deflect away falling objects which might otherwise land on the buoy or become wedged between the buoy and the bracket. A recess 26 is formed in the bracket behind a portion of the length of the antenna cone 16. The recess provides an area where the antenna cone 16 may be manually grasped while the buoy is mounted in the bracket in order to facilitate handling of the buoy when mounting or removing the buoy relative to the bracket. A flexible strap 27 securely holds the buoy against the mounting bracket 12. A strike 28 attached to the end of the flexible strip 27 engages a bail on a manual overcenter latch 29 which is attached to the mounting bracket 12. The latch 29, by its overcenter action, firmly secures the buoy when the buoy is in the proper position in the mounting bracket.

Figure 2:
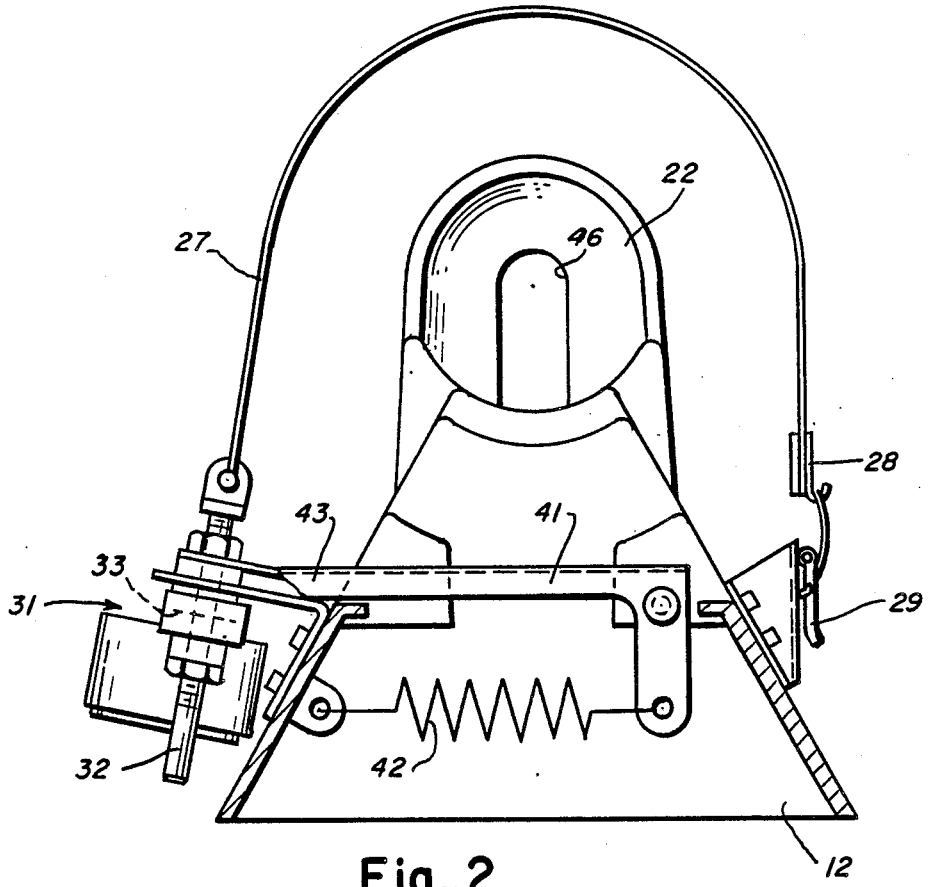
FIG. 2 is a top sectional view of the mounting bracket with the buoy removed.

As shown in FIG. 2, the other end of the flexible strap 27 is attached to a severable bolt 32 which is mounted in a condition responsive release mechanism 31. A knife 33 in the release mechanism 31 is driven by a compression spring (not shown) which is normally in the compressed condition. The pressure responsive release mechanism includes a module 34 which is sensitive to ambient pressure. Immersing the release mechanism in sea water to a depth of between 4.5 and 12 feet causes the mechanism to release the spring which drives the knife 33 through the severable bolt 32, thus releasing the top half of the bolt 32 and the end of the flexible strap 2.

The mounting bracket 12 also includes a pivoted ejection arm 41 one end 44 of which is coupled to a tension spring 42. The other end 43 of the ejection arm 41 is held in a cocked position by the severable bolt 32. When the top portion of the bolt 32 is released by the cutting edge of the knife 33, the end 43 of the ejection arm is likewise released. The tension spring 42 causes the ejection arm to eject the buoy from the mounting bracket.

Figure 3:
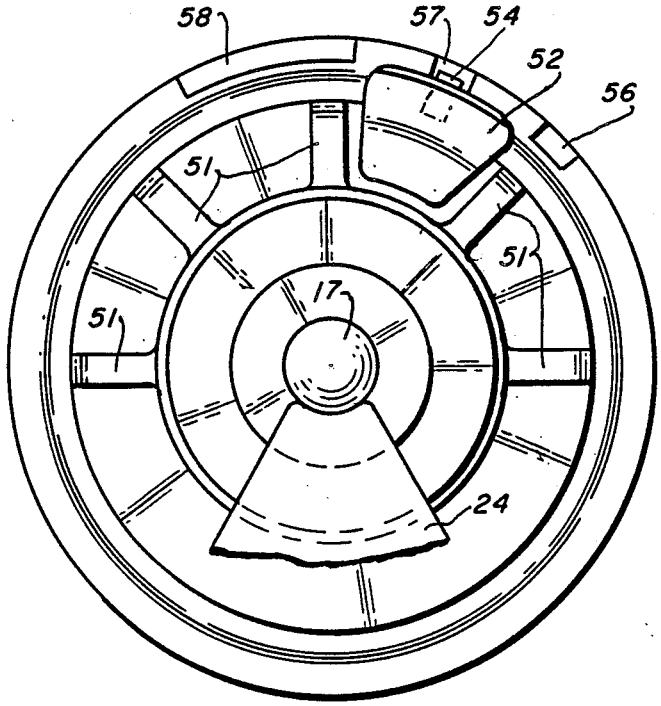
FIG. 3 is a top view of the switch ring.
Figure 8:
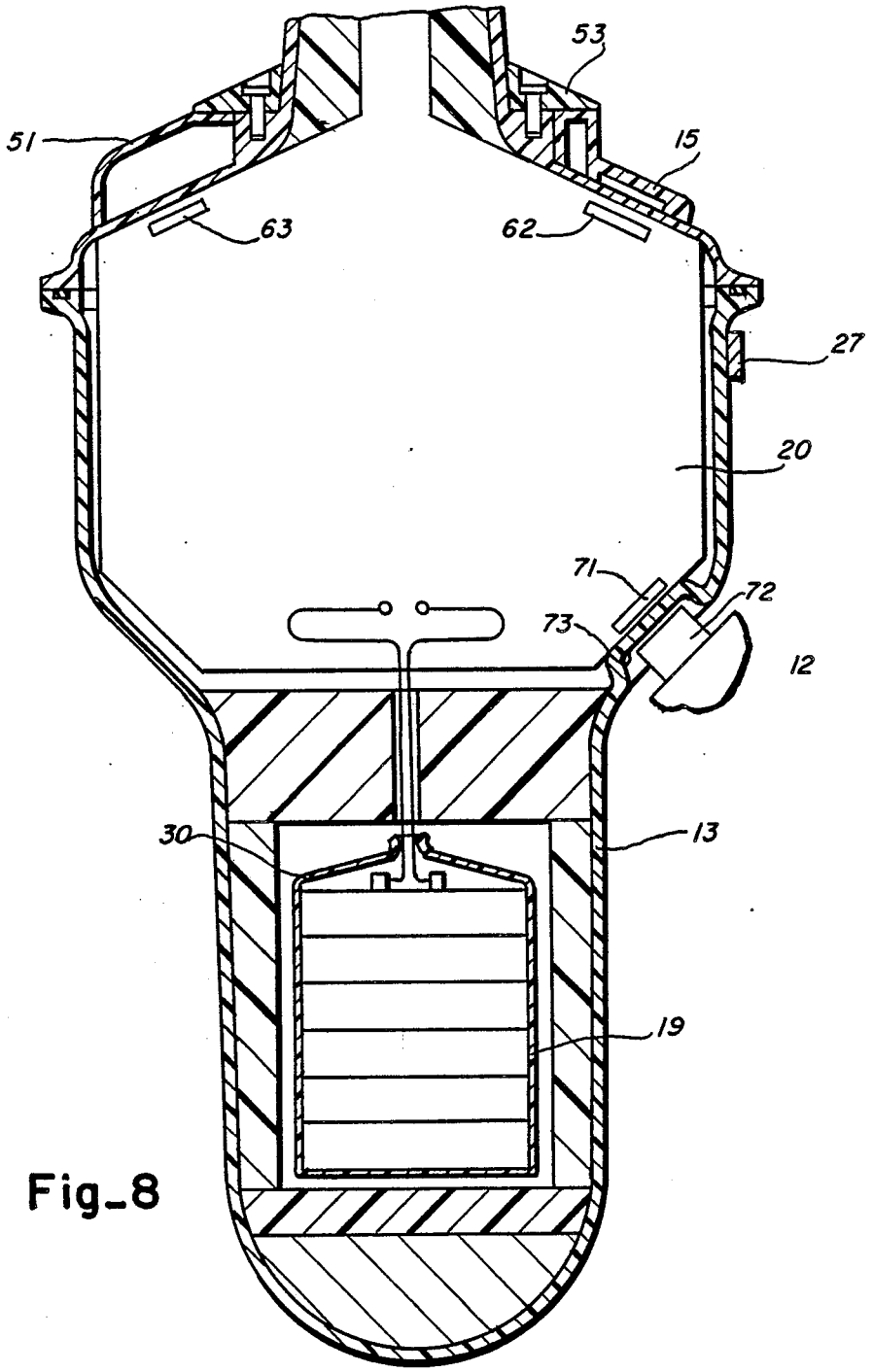
FIG. 8 is a sectional view showing a portion of the interior of the buoy housing.

Turning now to FIG. 3, it will be seen that the annular switch ring 15 includes a number of radial vanes 51 and a lift tab 52. The switch ring 15 is rotatable with respect to the antenna cone 16 and is held adjacent the deck portion 14 by a retainer ring 53. The lift tab 52 includes a latch 54 which extends downward from the lift tab 52 and engages one of three depression catches 56, 57, and 58 formed on the deck portion 14 of the EPIRB immediately beneath the switch ring 15. The catch position 56 corresponds to the ON position of the switch ring 15, the catch position 57 corresponds to the OFF position of the switch ring 15, and the catch position 58 corresponds to the SET and TEST positions of the switch ring 15. The circuit card 20, also seen in FIG. 8, is positioned in the lower cylindrical portion 18 of the EPIRB immediately beneath the switch ring 15, and two magnetic reed switches 62 and 63 are mounted adjacent the top edge on the circuit card 20. The annular switch ring 15 includes four magnets which are annularly spaced around the switch ring 15 and are used to open and close the switches 62 and 63 depending on the rotational position of the ring. The use of magnets outside of the buoy housing to actuate switches inside of the buoy housing avoids the requirement of holes in the buoy housing through which switch actuators and wires would pass.

Figure 4:
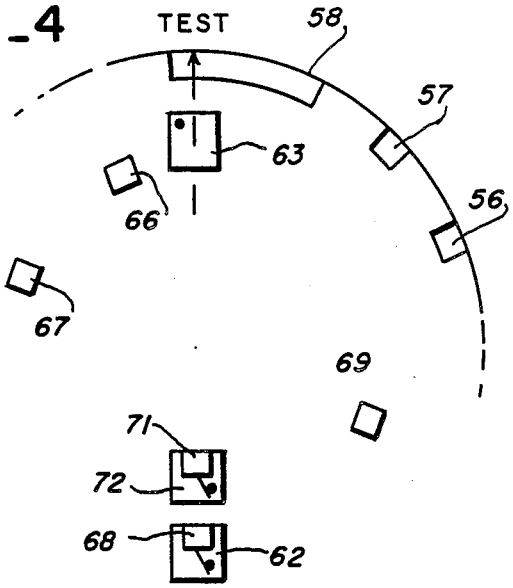
FIGS. 4–7 are schematic diagrams showing the switch ring in the Test, Set, Off, and On positions.
Figure 5:
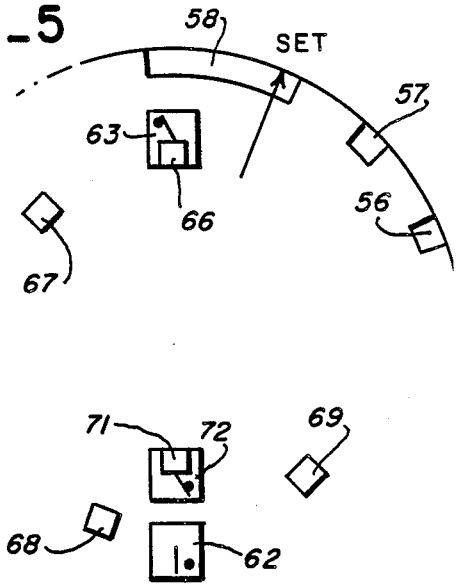
Figure 6:
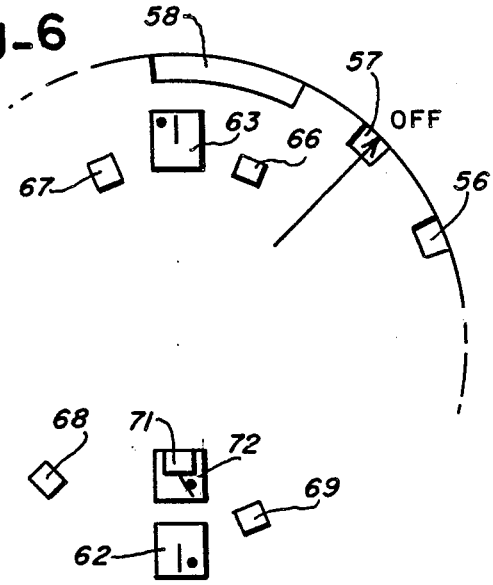
Figure 7:
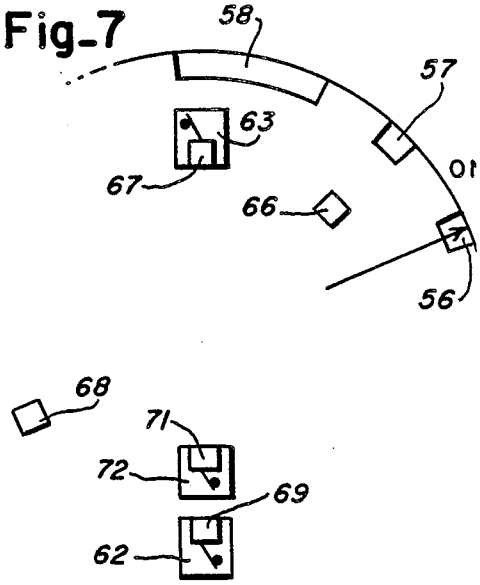

As shown in FIGS. 4, 5, 6, and 7, with the latch 54 of the lift tab 52 in the respective catches 56–58, the four magnets 66–69 act with the two magnetic switches 63 and 62 to place the EPIRB transmitter in the ON, OFF, SET, or TEST modes. As shown in FIG. 4, with the switch ring in the TEST position, switch 62 is closed by the magnet 68. As shown in FIG. 5, with the switch ring in the SET position, switch 63 is closed by the magnet 66. As shown in FIG. 6, with the switch ring in the OFF position, neither of the switches 62 or 63 are closed by the magnets. As shown in FIG. 7, with the switch ring in the ON position, switches 62 and 63 are closed by the magnets 69 and 67, respectively. The control of the two magnetic switches 62 and 63 by the four magnets 66–69 can be summarized as follows:

| Switch Ring Position | Switch 62 | Switch 63 | Shown In |
|---|---|---|---|
| TEST | Closed | Open | FIG. 4 |
| SET | Open | Closed | FIG. 5 |
| OFF | Open | Open | FIG. 6 |
| ON | Closed | Closed | FIG. 7 |

The annular switch ring may be placed into either the ON, OFF, SET, or TEST position as desired. In the ON or OFF position, the latch 54 is engaged in the catch 56 or the catch 57, respectively; and in the SET position, the latch 54 is positioned in the catch 58. The catch 58 is wide enough to allow the switch ring to be moved to the TEST position without lifting the lift tab 52. However, the switch ring is spring loaded between the SET and the TEST position to automatically return to the SET position from the TEST position once the ring has been released. This allows the transmitter buoy to be tested by turning the switch ring to TEST and then by releasing the switch ring and allowing the ring to automatically return to the SET position.

As shown in FIG. 8, the circuit card 20 contains an additional magnetic reed switch 71 which functions as a proximity switch. The switch 71 is located too far from the magnets 66–69 on the switch ring 15 to be effected thereby. The magnetic switch 71 is controlled by a fifth magnet 72 which is located on the mounting bracket 12 below the flexible strap 27. When the buoy is mounted in the bracket, the magnet 72 opens the switch 71. Removing the buoy from the bracket, however, distances the magnet 72 from the switch 71 allowing the switch 71 to close. The switch 71 only effects the operation of the buoy transmitter when the switch ring 15 is in the SET position and can be summarized as follows:

| Switch Ring Position | Switch 71 | Buoy Transmitter |
|---|---|---|
| SET | Open | Not Transmitting |
| SET | Close | Transmitting |

The magnet 72 is placed on the mounting bracket to protrude therefrom into the envelope of the buoy. The buoy is formed with a detent 73 to allow reception of the magnet 72; and this feature provides a keying function to insure that the buoy, which is otherwise symmetrical about its longitudinal axis, is placed in the mounting bracket in the proper orientation allowing the magnet 72 to open the switch 71.

Figure 9:
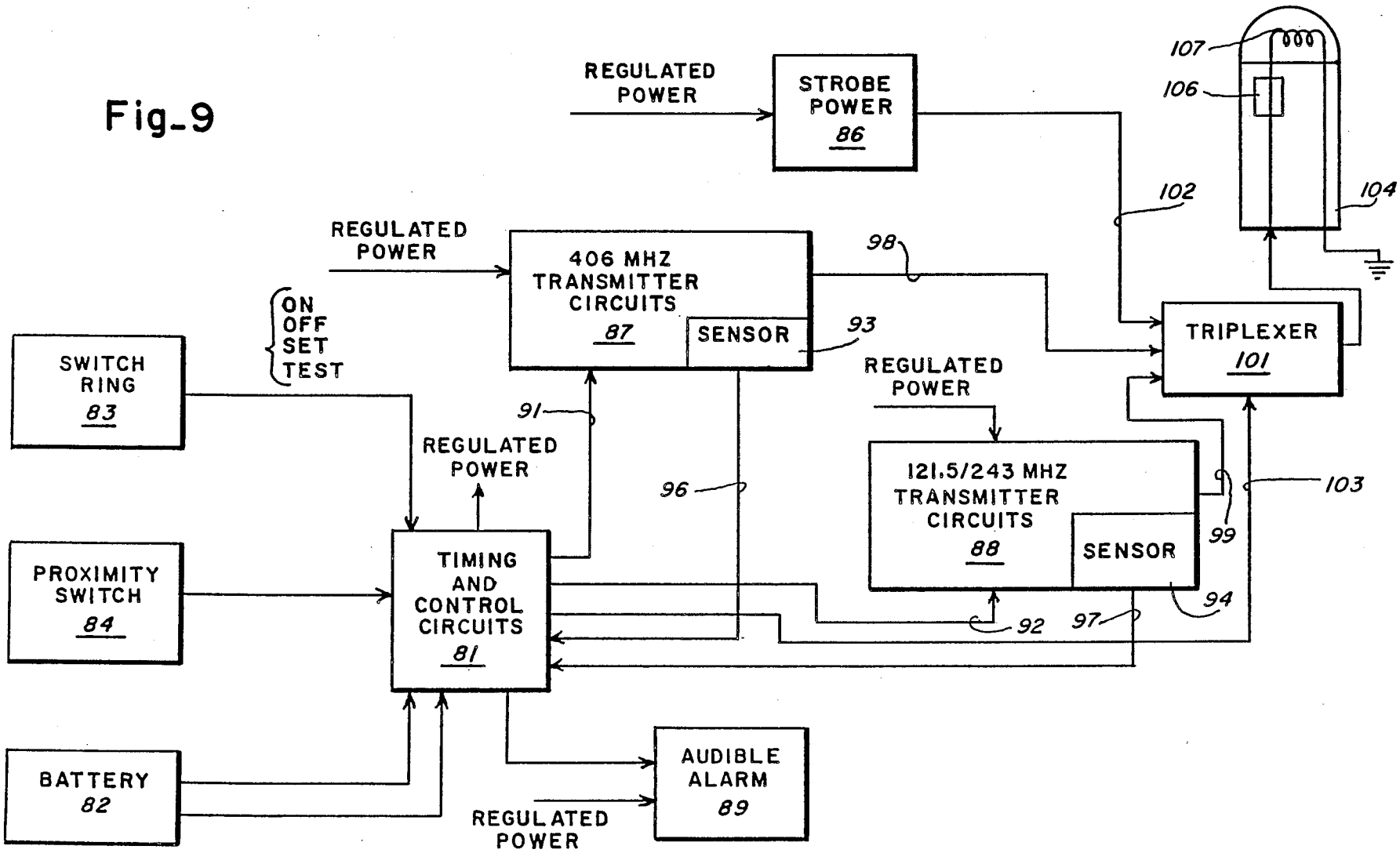
FIG. 9 is a schematic diagram of the buoy transmitter and the transmitter controls.

FIG. 9 is a schematic diagram of the buoy transmitter and the associated controls. The timing and control circuits 81 are powered by the battery 82 and receive signal inputs from the switch ring 83 and the proximity switch 84. The switch ring may be rotated to either the ON, OFF, SET, or TEST positions, and the proximity switch 84 senses whether or not the buoy is positioned in the mounting bracket. The timing and control circuits 81 provide regulated power to the strobe light power supply 86, the 406 mhz transmitter circuits 87, the 121.5 and 243 mhz transmitter circuits 88, and the audible alarm 89. The timing and control circuits 81 supply control signals to the 406 mhz transmitter circuits 87 on line 91, to the 121.5 and 243 mhz transmitter circuits on line 92 and to the audible alarm 89. Each of the transmitter circuits 87 and 88 includes a transmission sensor 93 and 94, respectively. Each of the transmission sensors 93 and 94 senses that the transmitter circuit is operating properly by responding to a transmission burst of less than one millisecond from the transmitter and sending a control pulse on control lines 96 and 97, as appropriate, to the timing and control circuits 81. The transmitter circuits 87 and 88 are coupled by output lines 98 and 99, respectively, to a triplexer 101, which is also coupled to the strobe light power supply 86 by a line 102 and to the timing and control circuits 81 by a strobe pulse line 103. The triplexer is coupled to the transmitting antenna 104 and to a strobe charging circuit 106 and the strobe lamp 107, both of which are physically located on the antenna 104.

In the event that the transmitter circuit 88 only transmits one of the 121.5 and 243 mhz signals, a diplexer may be substituted for the triplexer 101.

TRANSMITTER MODE OF OPERATION

The EPIRB transmitter and the switch ring controls are designed to be simple to operate and to eliminate false alarms. The radial vanes 51 provide a convenient means for gripping and turning the switch ring to the desired setting, and the latch 54 on the lift tab 52 locks the switch ring against unintended rotation. The lamp 17 and the audible alarm 29 also provide visual and aural indications of the state of the buoy transmitter as described below.

When the switch ring is in the OFF position, the transmitters 87 and 88 cannot transmit, the lamp 107 is off, and the alarm 89 is off. When the switch ring is in the ON position, the transmitters 87 and 88 will transmit after a one minute delay; but the lamp 107 and the alarm 89 will turn on immediately to alert an operator that the transmitter is set to ON. When the switch ring is in the SET position and the buoy is in the bracket 12, the transmitters 87 and 88, the lamp 107, and the alarm 89 will be off; removing the buoy from the bracket will open the proximity switch 84, activate the lamp and the alarm, and the transmitters will transmit after a one minute delay. The lamp and the alarm will alert an operator that the transmitters are in an active state; and in the event that transmitter turn on is not intended, the switch ring can be turned to the OFF position. The one minute delay between the lamp and alarm activation and the buoy transmission provides an opportunity to turn the switch ring to OFF before a false alarm is sent to the SARSAT satellites. If transmitter turn on is intended because of an emergency situation, manual removal or automatic ejection of the buoy from the bracket will activate the lamp and the alarm and assure an operator that the buoy is operating. In order to conserve battery power, the alarm 89 will only stay on for a period of 5 minutes or less and will then be turned off by the timing and control circuits 81.

When the switch ring is moved to the TEST position, the transmitters 87 and 88 will transmit for approximately one millisecond to allow the internal sensors 93 and 94 to sense the transmitted signals. Once the transmitted signals are sensed by the sensors 93 and 94, the lamp 107 will flash rapidly to indicate to an operator that the buoy transmitter is in working order. Release of the switch ring will allow the switch ring to automatically return from the TEST to SET position, and the lamp will turn off. The one millisecond transmission by the transmitter during the TEST is not sufficient to signal an alarm condition to the SARSAT satellites

Having thus described the invention, various alterations and modifications will occur to those skilled in the art, which modifications and alterations are intended to be within the scope of the invention as defined by the appended claims.

What is claimed is:

1. A bracket assembly for mounting a transmitter buoy on marine vessel, the assembly comprising:
   - a rigid elongated bracket body having one side adapted for attachment to a marine vessel and an opposite side for receiving a transmitter buoy;
   - a lower shelf means for supporting the buoy;

a flexible strap attached to the bracket body for encircling the buoy to secure the buoy to the bracket body;

a manual latch mechanism on a first end of the flexible strap for manual fastening or release of the buoy relative to the bracket body; and a condition responsive release mechanism on a second end of the flexible strap for automatically releasing the second end of the strap in response to the occurrence of a preselected condition.

2. The bracket assembly of claim 1 further comprising:

a severable bolt attached to the second end of the flexible strap;

a knife in alignment with the severable bolt and means for driving the knife through the severable bolt in response to said preselected condition.

3. The bracket assembly of claim 2 further comprising:

an ejection mechanism for positively ejecting the buoy from the bracket body.

4. The bracket assembly of claim 3 wherein the ejection mechanism is responsive to the said preselected condition.

5. The bracket assembly of claim 4 further comprising:

a spring loaded ejection arm comprising the ejection mechanism; and means for holding the ejection arm in a cocked position by means of the severable bolt, whereby the severing of the severable bolt by the knife allows the ejection arm to eject the buoy from the bracket body.

6. The bracket assembly of claim 5 wherein the preselected condition comprises water pressure acting on the release mechanism when the bracket assembly is immersed in water.

7. A bracket assembly and a transmitter buoy which is mounted on the bracket assembly comprising:

a transmitter buoy having an axial length;

a rigid elongated bracket body having one side adapted for attachment to a support surface of a marine vessel and an opposite side for receiving the transmitter buoy;

a support means comprising a cup-shaped lower shelf on the bracket body for supporting the buoy;

a top rest on the upper end of the bracket body for receiving the top portion of the buoy, wherein the top rest extends above the top portion of the buoy body and is closely adjacent thereto to protect the said top portion from falling objects and to prevent objects from becoming positioned between the buoy top portion and the bracket body top rest; and wherein the top rest is smooth, continuous, and sloped downward from the support surface to prevent ropes or poles from becoming positioned between the buoy top portion and the support surface of the marine vessel.

8. The bracket assembly and transmitter buoy of claim 7 further comprising:

a recess in the bracket body below the top rest and spaced from the buoy when the buoy is mounted in the bracket, whereby the buoy may be gripped by the hand of an operator inserted into the recess while the buoy is mounted in the bracket.

9. The bracket assembly and transmitter buoy of claim 8 further comprising:

a rounded bottom on the transmitter buoy;

a concave rest comprising the lower shelf for receiving the round bottom of the transmitter buoy; and a drain slot in the concave rest to prevent the accumulation of water and debris between the round bottom of the buoy and the concave rest.

10. A switch mechanism for a transmitter buoy in a mounting bracket comprising:

a transmitter buoy;

a mounting bracket;

a mode switch on the transmitter buoy having ON, OFF, and SET positions, wherein the transmitter buoy will transmit a preselected message when the mode switch is in the ON position and will be off when the mode switch is in the OFF position; and SET control means for preventing transmission of said preselected message when the mode switch is in the SET position and the buoy is in the mounting bracket, and for automatically transmitting said preselected message when the mode switch is in the SET position and the buoy is removed from the mounting bracket.

11. The switch mechanism of claim 10 wherein a proximity switch in the buoy and a means for activating the proximity switch on the mounting bracket comprise the SET control means.

12. The switch mechanism of claim 11 wherein a reed switch in the buoy comprises the proximity switch and a magnet on the bracket comprises the means for activating.

13. The switch mechanism of claim 10 wherein the mode switch comprises an annular switch ring mounted on the outside of the transmitter buoy, and rotation of the switch ring relative to the transmitter buoy moves the mode switch to the ON, OFF, and SET positions.

14. The switch mechanism of claim 13 further comprising:

a latch mounted on the switch ring;

a series of catch positions which engage the latch arranged in an arcuate pattern on the transmitter buoy, wherein the catch positions correspond to the ON, OFF, and SET positions of the mode switch; and wherein the mode switch cannot be rotated from any of the ON, OFF, or SET catch positions to another without releasing the latch from the respective catch.

15. The switch mechanism of claim 14 further comprising:

a TEST position for the mode switch; and a common catch position for the SET position and the TEST position of the mode switch;

wherein the switch ring is spring loaded between the SET and TEST position, whereby the mode switch may be manually rotated to the TEST position from the SET position against the spring loading, and whereby upon release the mode switch automatically returns from the TEST position to the SET position.

16. The switch mechanism of claim 15 further comprising:

a plurality of magnets mounted in the switch ring; and a plurality of reed switches mounted in the transmitter buoy adjacent the switch ring, whereby rotation of the switch ring activates the reed switches to put the transmitter buoy in the ON, OFF, SET, or TEST mode.

17. A transmitter buoy for transmitting a distress signal in the event of an emergency situation comprising;

an elongated buoy body comprising a lower cylindrical base portion, a middle deck portion, and an upper slender antenna cone;

an electronic transmitter and a battery pack located in the base portion;

an annular switch ring rotatably mounted on the deck portion;

a transmitting antenna mounted in the antenna cone; and an illumination device mounted on the top of the antenna cone.

18. The transmitter buoy of claim 17 further comprising:

a clamping ring securing the cylindrical base portion to the deck portion;

sealing means to prevent the ingress of water at the seam between the cylindrical portion and the deck portion; and waterproof enclosure means surrounding the battery pack.

19. The transmitter buoy of claim 18 wherein the clamping ring is removable to allow separation of the cylindrical base and the deck portion.

20. The transmitter buoy of claim 18 further comprising:

a strobe light comprising the illumination device.

21. The transmitter buoy of claim 20 wherein the strobe light is a xenon gas strobe light.

22. The transmitter buoy of claim 17 further comprising:

a latch mechanism on the annular switch ring to lock the switch ring against rotation; and a release for the latch mechanism to allow rotation of the switch ring.

23. The transmitter buoy of claim 22 further comprising:

ON, OFF, and SET positions for the annular switch ring;

magnet means mounted on the switch ring; and magnet responsive switch means in the cylindrical body and responsive to the position of the magnet means to place the transmitter buoy in the ON, OFF, or SET mode.

* * * * *